US005356554A

United States Patent [19]

Delwel et al.

[11] Patent Number: 5,356,554

[45] Date of Patent: Oct. 18, 1994

[54] BLEACH CATALYST COMPOSITION, MANUFACTURE AND USE THEREOF IN DETERGENT AND/OR BLEACH COMPOSITIONS

[75] Inventors: Francois Delwel, Dordrecht; Marten R. van Vliet, Rotterdam, both of Netherlands

[73] Assignee: Lever Brothers Company, Division of Conopco, Inc., New York, N.Y.

[21] Appl. No.: 978,554

[22] Filed: Nov. 19, 1992

[30] Foreign Application Priority Data

Nov. 20, 1991 [GB] United Kingdom ..... 9124581

[51] Int. Cl.[5] ..... G11D 3/395

[52] U.S. Cl. ..... 252/94; 252/89.1; 252/95; 502/167; 502/170

[58] Field of Search ..... 252/94, 95, 89.1; 502/167, 170

[56] References Cited

U.S. PATENT DOCUMENTS

| | | | |
|---|---|---|---|
| 4,626,373 | 12/1986 | Finch et al. | 252/90 |
| 4,728,455 | 3/1988 | Rerek | 252/99 |
| 5,114,611 | 5/1992 | Van Kralingen et al. | 252/95 |
| 5,153,161 | 10/1992 | Kerschner | 502/167 |
| 5,194,416 | 3/1993 | Jureller et al. | 252/95 |

FOREIGN PATENT DOCUMENTS

| | | |
|---|---|---|
| 42939/89 | 5/1990 | Australia . |
| 0072166 | 2/1983 | European Pat. Off. . |
| 01243441 | 11/1984 | European Pat. Off. . |
| 0225663 | 6/1987 | European Pat. Off. . |
| 0306089 | 3/1989 | European Pat. Off. . |
| 0369841 | 5/1990 | European Pat. Off. . |
| 392592 | 10/1990 | European Pat. Off. . |
| 0458397 | 11/1991 | European Pat. Off. . |
| 0458398 | 11/1991 | European Pat. Off. . |

OTHER PUBLICATIONS

EP Search Report EP 92 31 0504.

J. Am. Che M. Soc. (Weighardt et al) 1988, vol. 110, pp. 7398–7411, no month available.

J. Chem. Soc. Chem. Comm. (Weighardt et al) 1988, pp. 1145–1146, 22 Apr. 1988.

*Primary Examiner*—Paul Lieberman

*Assistant Examiner*—Nicholas Ogden

*Attorney, Agent, or Firm*—Milton L. Honig

[57] ABSTRACT

Bleach catalyst composition in the form of non-friable composite granules. Each granule is free from easily oxidisable organic materials and comprises a manganese complex catalyst; optionally an inert salt and a binding agent. Detergent compositions comprising such granules have good peroxide and enzyme stability.

11 Claims, No Drawings

BLEACH CATALYST COMPOSITION, MANUFACTURE AND USE THEREOF IN DETERGENT AND/OR BLEACH COMPOSITIONS

FIELD OF THE INVENTION

This invention relates to bleach catalyst compositions. More particularly, it relates to bleach catalyst compositions, comprising a manganese-complex as the active bleach catalyst, in a form that are suitable for use in or with a detergent and/or bleach composition. The invention also relates to a process for manufacturing the compositions and also to detergent and cleaning compositions containing said bleach catalyst compositions.

THE RELATED ART

Various manganese-complexes are known as effective catalysts for enhancing the activity of peroxygen bleaches. For example, manganese-gluconate complexes are described in EP-A-0,237,111; manganese-bipyridylamine complexes are described in EP-A-0,392,593; and manganese-polyol complexes are described in EP-A-0,443,651, as peroxygen bleach catalysts. The peroxygen bleaches which can be catalysed by manganese complexes include hydrogen peroxide, hydrogen peroxide liberating or generating compounds, and inorganic and organic peroxyacids.

In contrast to the so-called bleach activators or bleach precursors which function by a perhydrolysis reaction with a peroxygen compound, e.g. hydrogen peroxide or a source of hydrogen peroxide such as sodium perborate or sodium percarbonate, forming a peroxyacid in situ, these manganese-complexes are true catalysts which catalytically enhance the performance of peroxygen bleaching agents. Whereas the amounts of bleach precursors normally used in detergent, cleaning and/or bleaching compositions are in the order of percent by weight, the effective amounts of manganese-complex bleach catalysts needed in such compositions are normally in the order of hundredths of a percent, i.e. in quantities that are much lower than bleach precursors by a factor of a hundred. Not only would accurate dosing be very difficult at this very low dosage but also it would be difficult to achieve a homogeneous distribution of the catalyst throughout the detergent composition; a homogeneous distribution is essential for a consistent performance of each individual component within a detergent composition when used in the wash.

Spraying a solution of the manganese-complex (hereinafter also referred to as "bleach catalyst" or simply "catalyst") onto the base detergent formulation could result in a very good distribution, but also would involve direct contacts between the catalyst and other powder ingredients such as the peroxygen bleaching agent e.g. perborate and percarbonate; the nonionic detergent; and enzymes. This could result in a reduction in the amount of individual components present by, for example, peroxide formation and redox reactions.

Mixing pure crystals of the catalyst with a particulate detergent product may also introduce interactions with surrounding ingredients with consequent losses of active components. Moreover, in order to avoid segregation, the crystals of catalyst should have approximately the same size distribution as the rest of the product. However, crystals as big as the average detergent powder particle, say about 0.5 mm, would be visible as dark spots. (Manganese complex crystals are generally coloured). Another reason why crystals of this size would not be acceptable is their number. At a dosage level of say from 0.02 to 0.08% by weight the number of crystals in the product would be too low to obtain a good distribution over the product.

Hence pure catalyst material cannot normally be dosed as such to detergent powder compositions because of the very low dosage which makes it difficult for accurate dosing and homogeneous distribution, as well as for composition storage stability reasons.

In order to overcome the storage-stability problems it has been suggested to provide the catalyst in agglomerated form.

Catalytic heavy metal complexes in agglomerated form for use in detergent compositions are described in EP-A-0,072,166 (Procter & Gamble) and in EP-A-0,124,341 (Procter & Gamble). However, apart from disclosing agglomeration in general terms and disclosing the possibility of using various organic carriers and matrixes of water-soluble or water-dispersible inorganic salts, there is no specific disclosure of an agglomerate composition in EP-A-0,072,166. EP-A-0,124,341 only discloses agglomerates of iron-complexes with all sorts of materials.

SUMMARY OF THE INVENTION

The present invention is particularly concerned with an exceptionally highly reactive manganese complex catalyst as described in European Patent Specification No's 458 398 and 458 397 especially those of the following general formula (A):

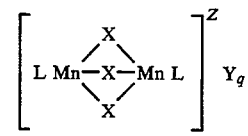

(A)

wherein Mn is manganese which can independently be in the III or IV oxidation state;

X is independently a coordinating or bridging species selected from the group consisting of $H_2O$, $O_2^{2-}$, $O^{2-}$, $-OH$, $HO_2^-$, $SH^-$, $S^{2-}$, $>SO$, $Cl^-$, $SCN^-$, $N_3^-$, $N^{3-}$, $RSO_3^-$, $RCOO^-$, $NH_2^-$ and $NR_3$, with R being H, alkyl, aryl, both optionally substituted, and $R^1COO$, where $R^1$ is an alkyl, or aryl radical, both optionally substituted;

L is a ligand which is an organic molecule containing a number of nitrogen which coordinates via all or some of its nitrogen atoms to the manganese centres;

Z denotes the charge of the complex and is an integer which can be positive or negative;

Y is a monovalent or multivalent counter-ion, leading to charge neutrality, which is dependent upon the charge z of the complex; and $q = {}^{z}/$ [charge Y].

Preferred manganese-complexes are those wherein X is either $CH_3COO^-$ or $O^{2-}$ or mixtures thereof, most preferably wherein the manganese is in the IV oxidation state and X is $O^{2-}$. Preferred ligands are those which contain at least three nitrogen atoms and which coordinate via three nitrogen atoms to one of the manganese centres, and preferably are of a macrocyclic nature. Particularly preferred ligands are those of formula:

$$\left[NR^3-(CR^1(R^2)_q)_t\right]_s$$

wherein t is an integer from 2 to 3; s is an integer from 3 to 4; q is zero or one; $R^1$ and $R^2$ are each independently selected from H, alkyl, aryl, both optionally substituted; and $R^3$ is independently selected from hydrogen, alkyl, aryl, both optionally substituted and, in particular, (1) 1,4,7-trimethyl-1,4,7-triazacyclononane, ($Me_3$-TACN), and (2) 1,2,4,7-tetramethyl-1,4,7-triazacyclononane, ($Me_4$-TACN).

The type of counter-ion Y for charge neutrality is not critical for the activity of the complex and can be selected from, for example, chloride; sulphate; nitrate; methylsulphate; surfactant-anions, such as the long-chain alkylsulphates, alkylsulphonates, alkylbenzenesulphonates, tosylate; trifluormethylsulphonate; perchlorate ($ClO_4^-$), $BPh_4^-$ and $PF_6^-$, though some counter-ions are more preferred than others for reasons of product property and safety.

Consequently the preferred manganese complexes usable in the present invention are:

(I) $[(Me_3\text{-TACN})\ Mn^{IV}\ (\mu\text{-O})_3Mn^{IV}\ (Me_3\text{-TACN})]^{2+}(PF_6^-)_2$ (II) $[(Me_4\text{-TACN})Mn^{IV}(\mu\text{-O})_3Mn^{IV}(Me_4\text{-TACN})]^{2+}(PF_6^-)_2$ (III) $[(Me_3\text{-TACN})Mn^{III}(\mu\text{-O})\ (\mu\text{-OAc})_2Mn^{III}(Me_3\text{-TACN})]^{2+}(PF_{6-})_2$ (IV) $[(Me_4\text{-TACN})Mn^{III}(\mu\text{-O})\ (\mu\text{-OAc})_2Mn^{III}(Me_4\text{-TACN})]^{2+}(PF_6^-)_2$ which are hereinafter also abbreviated as:

(I) $[Mn^{IV}_2(\mu\text{-O})_3(Me_3\text{-TACN})_2](PF_6)_2$ (II) $[Mn^{IV}_2(\mu\text{-O})_3(Me_4\text{-TACN})_2](PF_6)_2$ (III) $[Mn^{III}_2(\mu\text{-O})\ (\mu\text{-OAc})_2(Me_3\text{-TACN})_2](PF_6)_2$ (IV) $[Mn^{III}_2\ (\mu\text{-O})\ (\mu\text{-OAc})_2)\ (Me_4TACN)_2](PF_6)_2$ It is believed that for complex (I) the structural formula is as given below:

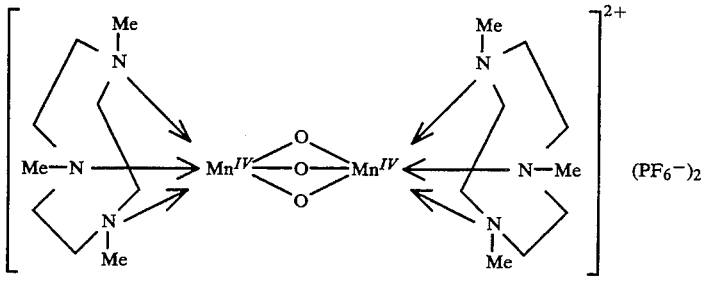

The present invention is also concerned with mononuclear manganese complex catalysts having the formula.

$$[LMn^{IV}(OR)_3]Y,$$

wherein Mn is manganese in the +4 oxidation state;

R is a $C_1$–$C_{20}$ radical selected from the group alkyl, cycloalkyl, aryl, benzyl and radical combinations thereof; at least two R radicals may also be connected to one another so as to form a bridging unit between two oxygens that coordinate with the manganese;

L is a ligand selected from a $C_3$–$C_{60}$ radical having at least 3 nitrogen atoms coordinating with the manganese; and Y is an oxidatively-stable counterion dependent.

Preferred complexes are those in which L is selected from 1,4,7-trimethyl-1,4,7-triazacyclononane and 2-methyl-1,4,7-trimethyl-1,4,7-triazacyclononane; and R is a $C_1$ alkyl.

Such mononuclear complexes are further described in U.S. Pat. No. 5,194,416 (Jureller et al).

Other mononuclear manganese complex catalysts are of interest are those of formula:

$$[L\ MnX_p]^z\ Y_q$$

wherein Mn can be either in the II, III or IV oxidation state; each X independently represents a coordinating species with the exception of $RO^-$, such as $Cl^-$, $Br^-$, $I^-$, $F^-$, $NCS^-$, $N_3^-$, $I_3^-$, $NH_3$, $RCOO^-$, $RSO_3^-$, $RSO_4^-$ in which R is alkyl or aryl, both optionally substituted, $OH^-$, $O_2^{2-}$, $HOO^-$, $H_2O$, SH, $CN^-$, $OCN^-$, $S_4^{2-}$ and mixtures thereof; p is an integer from 1–3; z denotes the charge of the complex and is an integer which can be positive, zero or negative; Y is a counter-ion the type of which is dependent upon the charge z of the complex; $q=z/[\text{charge } Y]$; and L is a ligand being a macrocylic organic molecule of the following formula:

$$\left[NR^3-(CR^1R^2)_t\right]_s$$

wherein t is 2; s is 3 and $R^1$, $R^2$ and $R^3$ can each independently be H, $C_1$–$C_6$ alkyl, or aryl, both optionally substituted.

Such mononuclear complex catalysts are further described in Applicant's copending British Patent Application 9127060.3.

For these highly reactive manganese complex catalysts (hereinafter also referred to as "bleach catalyst" or simply "catalyst") the problems with respect to incorporation in detergent and/or bleach compositions are much more serious in that it is definitely not possible to incorporate the pure catalyst material as such in detergent or cleaning powder compositions, because of:

i) the still lower dosage which makes it more difficult for accurate dosing and homogeneous distribution; and furthermore:

ii) increased peroxide instability upon storage;

iii) increased enzyme instability upon storage;

iv) catalyst instability upon storage; and possibly also v) instability of other detergent ingredients, such as fluorescent agents, fragrances and the like.

The catalyst of the preferred type must therefore, necessarily be presented in the form of either an agglomerate or a granule. Experiments however have shown that it is not easy to formulate a satisfactory bleach catalyst composition in granulated form that will meet the requirements of good storage stability, combined with good mechanical strength and fast delivery of the active catalyst to the wash. One of the main problems lies in the incompatibility of the catalyst with most conventional binding agents. Another problem is that agglomerates do not normally give sufficient protection to satisfactorily avoid peroxide instability.

A bleach catalyst composition comprising a manganese complex as the active bleach catalyst in a form that will meet the above requirements and is, therefore, suitable for use in or with a detergent and/or bleach composition has now been found.

DETAILED DESCRIPTION

Accordingly the invention provides a bleach catalyst composition in the form of non-friable composite granules, characterised in that each individual granule is free from easily oxidisable organic materials, especially primary and secondary alcohols and these easily oxidisable organic materials are present at levels of less than 1% by weight of the granule, and comprises a uniformly distributed mixture of from 0.5–8%, preferably from 2–5% by weight of a manganese complex catalyst, from 0–90%, preferably from 50–90% by weight of an inert salt selected from chlorides, carbonates and mixtures thereof, and from 5–91%, preferably from 5–30%, by weight of a binding agent selected from the group of water-soluble non-oxidisable polymers, alkalimetal silicates and saturated fatty acid/soap mixtures, and mixtures thereof.

Preferably the binding agent should have a melting point of above 30° C.

A preferred inert salt is sodium carbonate, preferably in the form of so-called "light soda ash" as commercially available. A preferred binding agent is sodium silicate, preferably alkaline sodium silicate having $SiO_2$:$Na_2O$ ratio of about 1.5 to 2.5, particularly about 1.8 to 2.2. Non-oxidisable polymers usable herein are non-cellulosic homo- or co-polymeric materials of relatively low molecular weights of from about 500–10000, such as for example polyvinylpyrrolidone (PVP), polyethyleneglycol (PEG), polyacrylates (PAA) and maleate-acrylate copolymers (CP).

Preferably the catalyst within the granules is of an average particle size as small as possible preferably below 200 μm for proper distribution and to ensure fast delivery of the catalyst to the wash, though too small particles may cause handling problems during the granulation process. A preferred and optimum catalyst particle size is within a range of between about 50 and about 150 μm.

Primary catalyst particles larger than 150 μm may give distribution problems and are more difficult to granulate, whereas particles smaller than 50 μm may cause handling problems and excessive granule coloration.

If desired the granules may be further provided with a coating layer of a non-oxidisable water-soluble material which may or may not be the same as the binding agent.

By coating the storage stability is only marginally improved, but the granulate colour may be further improved.

In a further preferred embodiment the granules are provided with a surface powder coating. This powder coating comprises a very fine flow-aid particulate material with mean particle size of less than 20 μm, preferably less than 15 μm, and may amount to from 2% to about 10% by weight of the total composite granule. The powdered coating material must be dispersible in water and can be organic or inorganic material which should retain its powder character when subject to prolonged storage conditions. It can be crystalline or amorphous in character, the only requirement being that it promote flow of the coated particles. Preferably crystalline materials should have a cubic, rhombic or other uniformly dimensioned crystalline habit. Non-crystalline materials should preferably be in spherical form. Suitable flow-aid materials usable herein are for example fine silica, talc, smectite clay minerals and synthetic sodium aluminosilicates, such as those identified as zeolites, e.g. zeolite A. The flow-aid powder coating also aids in controlling the granule growth during manufacture.

Alternatively the flow-aid powdered material can be embedded in the coating layer, which is found to have the advantage of improving the whiteness appearance of the granulate.

Granule growth control is necessary since one should aim at granules of the same approximate size and bulk density as the main detergent or cleaning powder into which they are incorporated so as to avoid segregation by percolation or segregation by floating.

Percolation, bringing the bleach catalyst composite granules to the bottom of a detergent powder batch, pack etc., may occur during and after mixing by vibration, handling and aeration, and will specifically happen with too small and too dense granules.

Floating will happen specifically with granules which are too large and too light. Both phenomena should be avoided, because they introduce errors in amounts dosed to a washing machine.

Depending on the use, the density of the granules of the catalyst composition can be varied at will. With a catalyst granule/base detergent density ratio of between approximately 0.8 and 1.2 very little segregation (CV $<5\%$) would occur for catalyst granule sizes deviating not more than a factor of 1.2 from the base particle size. In other words, for equal bulk density (BD) and a base mean particle size Dm of 500 μm, one should aim at a catalyst mean granule size Dm of 420–600 μm.

The BD and granule size can be controlled via the composition, the process conditions or both.

The bleach catalyst composition of the invention can be prepared by any of the conventional and known granulation techniques, such as using a pan-granulator, fluidised bed, Schugi mixer, Lodige ploughshare mixer, rotating drum and other low energy mixers; by compaction, including extrusion and tabletting optionally followed by pulverising and grinding; and by a high shear-energy process using a high-speed mixer/granulator equipment having both a stirring action of high energy and a cutting action. Examples of such high-speed mixer/granulator equipment are the Fukae (Trade Mark) FS-G mixer manufactured by Fukae Powtech Kogyo Co. Japan. Other mixers usable in the process of the invention include the Diosna (Trade Mark) V series ex. Dierks & Sohne, Germany; the Pharma matrix (Trade Mark) ex T K Fielden Ltd England; the Fuji (Trade Mark) VG-C Series ex Fuji Sangyo Co. Japan; and the Roto (Trade Mark) ex Zanchette & Co. S.r.1. Italy.

The invention also provides a detergent bleach composition comprising non-friable composite granules containing a manganese complex catalyst, optionally an inert salt, and a binding agent.

The detergent composition according to the invention may further contain ingredients commonly present in such compositions. They include surface active materials including soaps, synthetic anionic, nonionic, cationic and zwitterionic detergent surfactants preferably present in an amount from 0.5 to 50% by weight.

If the composition contains both anionic and nonionic surfactant, it is preferred that the nonionic surfactant is present in excess amount. Other ingredients include detergency builders such as aluminosilicates in particular zeolites, e.g. zeolite A, B, C, X and Y types as well as zeolite P as described in EP 384 070; and precipitating builders such as sodium orthophosphate and sodium carbonate. Such builders are preferably present in an amount from 5 to 80% by weight. Other typical ingredients include enzymes, fluorescent agents, multifunctional polymers, stabilising agents such as ethylene diamine tetraacetate (EDTA) and the polyphosphonic acid derivatives (e.g Dequest ®).

Such detergent compositions comprising the non-friable composite granules can be used to bleach stained substrates by contacting the substrate in aqueous medium with the detergent composition.

The invention will now be further illustrated by the following non-limiting examples.

EXAMPLES

Preparation of Manganese Complex Compound (I)

Step I: SYNTHESIS OF $[Mn^{III}_2(\mu\text{-}O)_1(\mu\text{-}OAc)_2(Me_3\text{-}TACN)_2](ClO_4)_2.(H_2O)$ (V)

All solvents were degassed (first a vacuum was applied over the solvent for 5 minutes and subsequently argon gas was introduced; this procedure was repeated three times) prior to use (to exclude all oxygen, which oxidizes $Mn^{II}$ to $Mn^{IV}$ and causes the formation of $Mn^{IV}O_2$).

The reaction was carried out at room temperature, under argon atmosphere, unless otherwise stated.

In a 25 ml round-bottomed flask, equipped with a magnetic stirrer, 500 mg (2.91 mmol) 1,4,7-trimethyl-1,4,7-triazacyclononane was dissolved in 15 ml ethanol/water (85/15). This gave a clear, colourless solution (pH >11). Then 0.45 g (1.80 mmol) $Mn^{III}OAc_3$. 2aq was added and a cloudy, dark brown solution was obtained. After the addition of 1.00 g (7.29 mmol) NaOAc.3aq, the pH fell to 8. About 15 drops of 70% $HClO_4$ solution were added to adjust the pH of the reaction mixture to 5.0. After addition of 1.50 g (12.24 mmol) $NaClO_4$, the colour of the reaction mixture changed from brown to red within about 30 minutes. After the reaction mixture was allowed to stand for one week at room temperature, the product precipitated in the form of red crystals. Then the precipitate was filtered over a glass filter, washed with ethanol/water (85/15) and dried in a dessicator over KOH.

Step 2: SYNTHESIS OF $[Mn^{IV}_2(\mu\text{-}O)_3(Me_3\text{-}TACN)_2](PF_6)_2H_2O$ In a 50 ml round-bottomed flask, equipped with a magnetic stirrer, 661.4 mg of (V) (0.823 mmol crystals were pulverised, giving a purple powder) was dissolved in 40 ml of an ethanol/water mixture (1/1). After a five-minute ultrasonic treatment and stirring at room temperature for 15 minutes, all powder was dissolved, giving a dark-red-coloured neutral solution. 4 ml of triethylamine was added and the reaction mixture turned to dark-brown colour (pH >11). Immediately 3.55 g (21.12 mmol) of sodium hexafluorophosphate ($NaPF_6$) was added. After stirring for 15 minutes at room temperature, in the presence of air, the mixture was filtered removing some manganese dioxide, and the filtrate was allowed to stand overnight. A mixture of $MnO_2$ and red crystals was formed. The solids were collected by filtration and washed with ethanol. The red crystals (needles) were isolated by adding a few ml of acetonitrile to the filter. The crystals easily dissolved, while $MnO_2$, insoluble in acetonitrile, remained on the filter. Evaporation of the acetonitrile solution resulted in the product as red flocks.

In the Examples which follow, the tests and base powder compositions used were:

Experimental Storage Tests

Storage experiments were carried out in open plastic cups containing a sample of 20 g detergent powder. The cups were stored under well controlled conditions, i.e., 20° C./65% RH or 30° C./60% RH. In addition closed cups were stored at 30° C. As a function of time cups were taken out from the storage room and analysed for peroxide and/or active catalyst content.

Bleach Tests

Bleach experiments were carried out in model experiments, using 2 liter demineralised water, T=40° C., time=15 minutes, and pH=10.5 (maintained using NaOH).

Tea-stained test-cloths were used in the bleach experiments and the reflection was measured before and after the experiment.

The bleach values obtained after storage of the detergent powder with the manganese-complex catalyst granules were compared with the corresponding bleach value of an experiment carried out with a sample of pure crystalline manganese-complex catalyst, i.e. not in the form of an agglomerate, granulate.

The catalyst used in all experiments was manganese-complex compound (I).

Base powders used in the Experiments

| Base powder composition (% by weight) | A | B | C |
|---|---|---|---|
| sodium alkylbenzenesulphonate | 6 | 7 | 7 |
| Nonionic ethoxylate (3EO + 7EO) | 7 | 10 | 10 |
| Soap | 2 | 2 | 2 |
| Zeolite | 24 | 27 | 27 |
| Maleic acid-acrylic acid co-polymer | 3 | 4 | 4 |
| sodium carbonate | 9 | 13 | 8 |
| sodium sulphate | 24 | — | — |
| sodium perborate monohydrate | 15 | 15 | 20 |
| enzyme | — | 1 | 1 |
| TAED (tetra-acetyl ethylene diamine) | — | 6 | 6 |
| Minors (salts) + moisture | 10 | 15 | 15 |

EXAMPLE 1

Preparation of Catalyst Manganese Complex (I) Granules

1. Catalyst/sodium stearate/lauric acid granules:

14.7 grams of a 50/50 mixture of sodium stearate and lauric acid was melted at 80° C. until a homogeneous mixture was obtained. Subsequently 0.3 gram of micro crystalline catalyst material was added and the mixture was homogenized by stirring. After cooling the solid material was extruded as noodles.

2. Catalyst/sodium carbonate/sodium silicate/zeolite granules:

Unsieved light soda ash (ca 50%<125 μm) was mixed with catalyst <150 μm in a small "Moulinex" kitchen blender and granulated with 45% alkaline silicate solution. At the moment granulation was noticed, the process was stopped and zeolite powder was added. In this way excessive agglomeration did not occur. Extra silicate solution was added after the addition of zeolite to get rid of excessive dust. The granules were dried in an oven at 80° C. for 20 minutes. The oversize granules, i.e. greater than 1250 micron, were removed. The nominal dry granule composition was:

| | |
|---|---|
| Light soda ash | 52.8% |
| Catalyst | 1.2% |
| Sodium silicate | 18.5% |
| Zeolite (80%) | 14.0% |
| Bound water | 13.5% |

3. Catalyst/sodium carbonate/sodium silicate/zeolite granule:

The process described above in 2 was repeated with a coarse catalyst material fraction of particle size between 250–500 μm.

EXAMPLE II a) Peroxide storage stability of detergent powder (A) was compared with detergent powder (A) containing manganese complex (I) as bleach catalyst. The bleach catalyst was added as micro crystalline pure material. (Storage in open cup at 20° C./65% RH).

| | % peroxide remaining* | | |
|---|---|---|---|
| | t = 0 wk | t = 4 wks | t = 8 wks |
| Detergent powder A | 100 | 88 | 86 |
| Detergent powder A+ 0.04% catalyst (I) | 100 | 58 | 52 |

*determined using a standard hydrogen peroxide titration.

The above results show the negative influence of adding a manganese complex bleach catalyst on the storage stability of perborate monohydrate.

b) Peroxide storage stability of detergent powder A containing manganese complex (I) as bleach catalyst. The bleach catalyst was added as 2% of granules (1), as described above, containing 2% of the active manganese catalyst.

| | % peroxide remaining | | |
|---|---|---|---|
| Detergent Powder A | t = 0 wk | t = 4 wks | t = 8 wks |
| +0.04% catalyst | 100 | 58 | 52 |
| +granule (1) | 100 | 63 | 60 |
| without catalyst | 100 | 88 | 86 |

The results show that Derborate stability can be improved by adding the catalyst in the form of granules.

EXAMPLE III

In this example the bleach performance of 20 g of detergent powder A was examined. The increase in reflectance (ΔR) of tea-stained cotton test clothes after a bleach experiment, conditions as described above, was measured. Separate detergent powders containing the catalyst and the catalyst in the form of granule (1) were stored for 8 weeks before being used in the bleach experiments. As a control, the bleach performance of the detergent powder containing 0.04% catalyst was determined immediately after it was prepared.

| Formulation | ΔR |
|---|---|
| Detergent Powder A + catalyst | 5 |
| Detergent Powder A + granule (1) | 13 |
| Control | 21 |

EXAMPLE IV

In this example enzyme stability (enzyme=Savinase) was measured after a storage period of 4 weeks using the above described bleach experiment with a Savinase sensitive test cloth.

| Formulation | ΔR |
|---|---|
| Detergent powder A + 0.04% catalyst | 14 |
| Detergent powder A + 2% granule (1) | 18 |
| Control 1 (Det. powder A, no catalyst, with storage) | 23 |
| Control 2 (Det. powder A + 0.04% cat., no storage) | 25 |

From the above results it is clear that incorporation of a granulated bleach catalyst also improves the storage stability when the composition comprises enzymes, relative to a system in which the catalyst is not in the form of a granule.

EXAMPLE V

Bleach values measured on tea stain for detergent powder A with the granule (1) after storage for 1 month in closed cups at 30° C. are as follows:

| Formulation | ΔR |
|---|---|
| Powder + catalyst (0.04%) | 8 |
| Powder + granule (1) (2%) | 17 |
| Control (powder + catalyst, without storage) | 21 |

Stability improvement of the bleach system was obtained by granulation of the bleach catalyst. The advantage is also observable after storage in closed cups.

EXAMPLE VI

In the following series of experiments the manganese complex (I) catalyst was incorporated in detergent powder B containing a mixed TAED/perborate bleach system. In this series of experiments granules (2) and (3) were used, respectively.

| % of peroxide after storage for 6 weeks at 30° C./60% RH | |
|---|---|
| Powder B + 0.04% catalyst | 35% |
| Powder B + 3% granule (2) | 94% |
| Powder B + 3% granule (3) | 85% |
| Powder B without catalyst | 96% |

From the above results it is clear that both granules (2) and (3) protect the bleach system against decomposition. Granule (2) containing finer catalyst material provided better protection than granule (3) with coarser catalyst material.

EXAMPLE VII

In this example storage stability of percarbonates was examined in combination with granules (2) and (3). Base powder C was used.

Storage experiments were carried out for two weeks in open cups 37° C./70% RH.

| Formulation | Remaining peroxide % by weight |
|---|---|
| Powder C + 0.04% catalyst | 2 |
| Powder C + 3% granule (2) | 64 |
| Powder C + 3% granule (3) | 59 |
| Powder C without catalyst | 62 |

Both granules (2) and (3) gave a clear advantage on percarbonate stability over the use of the catalyst as is.

We claim:

1. A bleach catalyst composition in the form of non-friable composite granules characterised in that each individual granule is free from easily oxidisable organic materials; and comprises:

(i) from 0.5 to 8% by weight of a manganese complex catalyst selected from the group consisting of formula I, II and III as defined below:

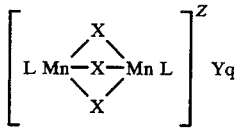

(I)

wherein Mn is manganese which can independently be in the III or IV oxidation state;

X is independently a coordinating or bridging species selected from the group consisting of $H_2O$, $O_2^{2-}$, $O^{2-}$, $-OH$, $HO_2^-$, $SH^-$, $S^{2-}$, $>SO$, $Cl^-$, $SCN^-$, $N_3^-$, $N^{3-}$, $RSO_3^-$, $RCOO^-$, $NH_2^-$ and $NR_3$, with R selected from H, alkyl, aryl, both optionally substituted and $R^1COO$, where $R^1$ is an alkyl, aryl, both optionally substituted;

L is a ligand which is an organic molecule containing a number of nitrogen atoms which coordinate via all or some of the nitrogen atoms to the manganese;

Z denotes the charge of the complex and is an integer which can be positive or negative;

Y is a monovalent or multivalent counter-ion leading to charge neutrality, which is dependent upon the charge of Z of the complex; and $q = {}^{z}/$ [charge Y];

$$[LMn^{IV}(OR)_3]Y, \quad \text{(II)}$$

wherein Mn is manganese in the +4 oxidation state; R is a $C_1$–$C_{20}$ radical selected from the group consisting of alkyl, cycloalkyl, aryl, benzyl and radical combinations thereof;

at least two R radicals may also be connected to one another so as to form a bridging unit between two oxygens that coordinate with the manganese;

L is a ligand selected from a $C_3$–$C_{60}$ radical having at least 3 nitrogen atoms coordinating with the manganese; and Y is an oxidatively-stable counterion dependent;

$$[L\ MnX_p]^{Z}Yq \quad \text{(III)}$$

wherein Mn Can be either in the II, III, or IV oxidation state;

X is independently a coordinating species with the exception of $RO^-$, selected from $Cl^-$, $Br^-$, $I^-$, $F^-$, $NCS^-$, $N_3^-$, $I_3^-$, $NH_3$, $RCOO^-$, $RSO_3^-$, $RSO_4^-$ in which R is alkyl, aryl, both optionally substituted, $OH^-$, $O_2^{2-}$, $HOO^-$, $H_2O$, SH, $CN^-$, $OCN^-$, $S_4^{2-}$ and mixtures thereof;

p is an integer from 1–3;

z denotes the charge of the complex and is an integer which can be positive zero or negative:

Y is a counter-ion the type of which is dependent upon the charge z of the complex;

$q = {}^{z}/$[charge Y]; and

L is a ligand being a macrocyclic organic molecule of the following formula:

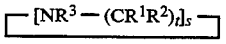

wherein t is 2; s is 3 and $R^1$, $R^2$ and $R^3$ can each independently be H, $C_1$–$C_6$ alkyl, aryl, both optionally substituted;

(ii) from 0 to 90% by weight of an inert salt selected from the group consisting of chlorides, carbonates and mixtures thereof; and (iii) from 5 to 91% by weight of a binding agent selected from the group consisting of water-soluble non-oxidisable polymers, alkalimetal silicates, saturated fatty acid soap mixtures and mixtures thereof.

2. A bleach catalyst composition according to claim 1 comprising from 50 to 90% by weight of the inert salt.

3. A bleach catalyst composition according to claim 1 wherein the binding agent has a melting point above 30° C.

4. A bleach catalyst composition according to claim 1 wherein the binding agent is alkaline sodium silicate.

5. A bleach catalyst composition according to claim 1 wherein the inert salt is sodium carbonate.

6. A bleach catalyst composition according to claim 1 wherein the average particle size of catalyst within the granule ranges from 50 to 200 μm.

7. A bleach catalyst composition according to claim 1 wherein the granules are provided with inorganic particulate material of a mean particle size less than 20 μm as a coating on an outer surface of the granules.

8. A method for preparing a bleach catalyst composition in the from of non-friable composite granules, each individual granule being free from easily oxidisable organic materials and comprising;

(i) from 0.5 to 8% by weight of a manganese complex catalyst selected from the group consisting of formula I, II and III as defined below:

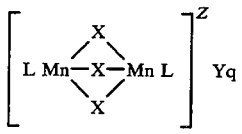

(I)

wherein Mn is manganese which can independently be in the III or IV oxidation state;

X is independently a coordinating or bridging species selected from the group consisting of $H_2O$, $O_2^{2-}$, $O^{2-}$, $-OH$, $HO_2^-$, $SH^-$, $S^{2-}$, $>SO$, $Cl^-$, $SCN^-$, $N_3^-$, $N^{3-}$, $RSO_3^-$, $RCOO^-$, $NH_2^-$ and $NR_3$, with R selected from H, alkyl, aryl, both optionally substituted and $R^1COO$, where $R^1$ is an alkyl, aryl, both optionally substituted;

L is a ligand which is an organic molecule containing a number of nitrogen atoms which coordinate via all or some of the nitrogen atoms to the manganese;

Z denotes the charge of the complex and is an integer which can be positive or negative;

Y is a monovalent or multivalent counter-ion leading to charge neutrality which is dependent upon the charge of Z of the complex; and $q = {}^{z}/$ [charge Y];

$$[LMn^{IV}(OR)_3]Y, \quad \text{(II)}$$

wherein Mn is manganese in the +4 oxidation state; R is a $C_1$–$C_{20}$ radical selected from the group consisting of alkyl, cycloalkyl, aryl, benzyl and radical combinations thereof;

at least two R radicals may also be connected to one another so as to form a bridging unit between two oxygens that coordinate with the manganese;

L is a ligand selected from a $C_3$–$C_{60}$ radical having at least 3 nitrogen atoms coordinating with the manganese; and Y is an oxidatively-stable counterion dependent;

$$[L\ MnX_p]^{Z}Yq \quad \text{(III)}$$

wherein Mn can be either in the II, III, or IV oxidation state;

X is independently a coordinating species with the exception of $RO^-$, selected from $Cl^-$, $Br^-$, $I^-$, $F^-$, $NCS^-$, $N_3^-$, $I_3^-$, $NH_3$, $RCOO^-$, $RSO_3^-$, $RSO_4^-$ in which R is alkyl, aryl, both optionally substituted, $OH^-$, $O_2^{2-}$, $HOO^-$, $H_2O$, SH, $CN^-$, $OCN^-$, $S_4^{2-}$ and mixtures thereof;

p is an integer from 1–3;

z denotes the charge of the complex and is an integer which can be positive, zero or negative;

Y is a counter-ion the type of which is dependent upon the charge z of the complex;

$q = {}^{z}/$[charge Y]; and

L is a ligand being a macrocyclic organic molecule of the following formula:

$$\left[ [NR^3 - (CR^1R^2)_t]_s \right]$$

wherein t is 2; s is 3 and $R^1$, $R^2$ and $R^3$ can each independently be H, $C_1$–$C_6$ alkyl, aryl, both optionally substituted;

(ii) from 0 to 90% by weight of an inert salt selected from the group consisting of chlorides, carbonates and mixtures thereof; and (iii) from 5 to 91% by weight of a binding agent selected from the group consisting of water-soluble non-oxidisable polymers, alkali-metal silicates, saturated fatty acid soap mixtures and mixtures thereof;

the method comprising forming a mixture of (i), (ii) and (iii) and thereafter granulating using an apparatus selected from the group consisting of a pangranulator; fluidised bed; low energy mixer, compaction equipment; and a combined mixer granulator.

9. A detergent composition comprising (i) 0.02 to 0.08% by weight of a bleach catalyst composition according to claim 1;

(ii) 0.5 to 50% by weight of a surface-active agent; and (iii) 5 to 80% by weight of a detergency builder.

10. A method for bleaching a stained substrate the method comprising contacting the stained substrate in aqueous medium with a detergent composition according to claim 1.

11. A bleach catalyst composition according to claim 1 wherein the granule is produced through extrusion and has a noodle form of a mean granule size Dm of 420–600 μm.

* * * * *